US008033429B2

(12) United States Patent
Keller

(10) Patent No.: US 8,033,429 B2
(45) Date of Patent: Oct. 11, 2011

(54) DISPENSING DEVICE FOR SINGLE USE

(75) Inventor: Wilhelm A. Keller, Merlischachen (CH)

(73) Assignee: Sulzer Mixpac AG, Haag (Rheintal) (CH)

( * ) Notice: Subject to any disclaimer, the term of this patent is extended or adjusted under 35 U.S.C. 154(b) by 994 days.

(21) Appl. No.: 11/629,200

(22) PCT Filed: Jul. 7, 2005

(86) PCT No.: PCT/CH2005/000391

§ 371 (c)(1),
(2), (4) Date: Dec. 12, 2006

(87) PCT Pub. No.: WO2006/005213

PCT Pub. Date: Jan. 19, 2006

(65) Prior Publication Data

US 2007/0175921 A1 Aug. 2, 2007

(30) Foreign Application Priority Data

Jul. 8, 2004 (CH) ..... 1170/04
Nov. 26, 2004 (CH) ..... 1954/04

(51) Int. Cl.
*B67D 7/78* (2010.01)

(52) U.S. Cl. ..... 222/145.6; 222/137; 222/153.09; 222/459; 222/567; 222/525; 433/90; 366/181.5; 366/339

(58) Field of Classification Search ..... 366/181.5, 366/336, 339–340, 399; 433/90; 285/361; 222/129.1–129.4, 145.1, 145.5–145.6, 137, 153.09, 459, 567, 522, 525
See application file for complete search history.

(56) References Cited

U.S. PATENT DOCUMENTS

| | | | | |
|---|---|---|---|---|
| 4,690,306 | A | 9/1987 | Staheli | |
| 4,846,373 | A * | 7/1989 | Penn et al. | 222/137 |
| 4,871,090 | A * | 10/1989 | Hoffmann | 222/81 |
| 5,301,842 | A | 4/1994 | Ritter | |
| 6,394,643 | B1 * | 5/2002 | Bublewitz et al. | 366/172.1 |

FOREIGN PATENT DOCUMENTS

| | | | |
|---|---|---|---|
| DE | 34 20 323 | A1 | 12/1985 |
| DE | 3420323 | A * | 12/1985 |
| DE | 101 32 416 | A1 | 1/2003 |
| EP | 0 319 135 | | 6/1989 |

* cited by examiner

*Primary Examiner* — Frederick C Nicolas
*Assistant Examiner* — Andrew Bainbridge
(74) *Attorney, Agent, or Firm* — Foley & Lardner LLP

(57) ABSTRACT

The dispensing device for single use includes a multicomponent cartridge with a closure and a mixer. The cartridge and the mixer form an interconnected unit and the closure, arranged between the outlets of the cartridge and the inlets of the mixer, is configured as a valve arrangement in order to establish a connection between the cartridge outlets and the mixing elements of the mixer after performing a relative movement between the mixer and the cartridge or syringe. In certain embodiments of the invention the connection is effected by rotation of the mixing unit relative to the cartridge, and in other embodiments of the invention by axial displacement of the mixing unit relative to the cartridge. This results in a disposable dispensing unit that can be economically produced and is particularly easy to use.

22 Claims, 14 Drawing Sheets

FIG. 29
FIG. 30
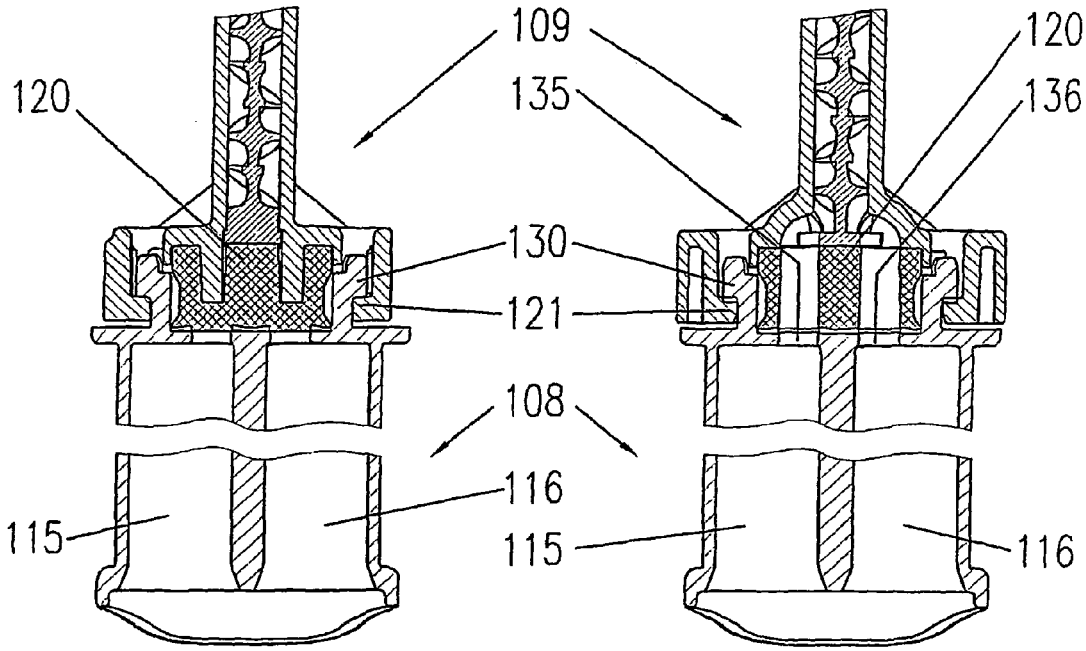
FIG. 29a
FIG. 30a
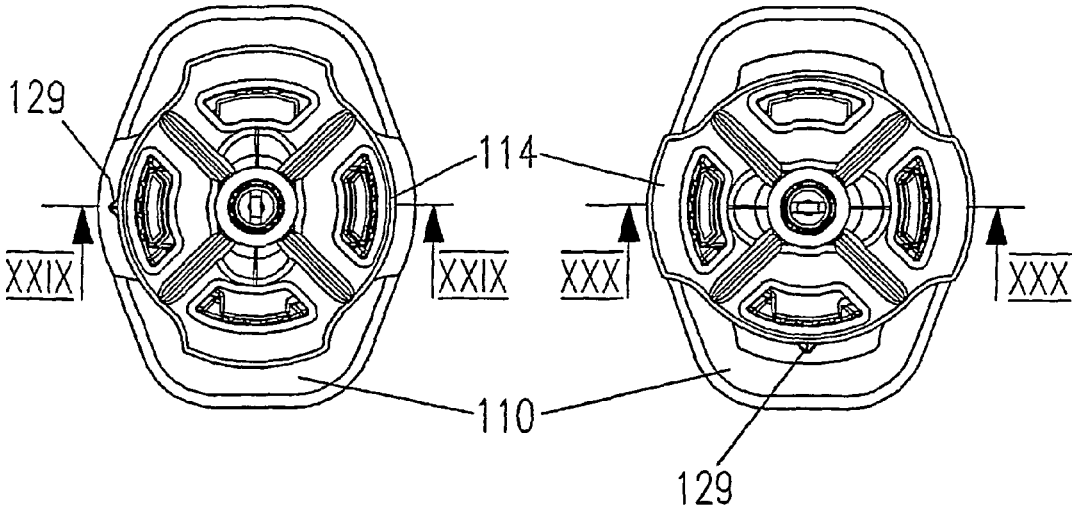

DISPENSING DEVICE FOR SINGLE USE

CROSS-REFERENCE TO RELATED APPLICATIONS

This Application is the National Phase of International Application No. PCT/CH2005/000391, filed Jul. 7, 2005, and published as WO 2006/005213, which in turn claims priority to Switzerland Application Nos. 1170/04 and 1954/04, the contents of these applications are herein incorporated by reference.

FIELD OF THE INVENTION

The present invention relates to a dispensing device for single use that includes a multicomponent cartridge with a closure and a mixer.

BACKGROUND OF THE INVENTION

Generally, such dispensing devices are reusable, i.e. the content of the double cartridge or double syringe is sufficient for multiple applications while the static mixer can only be used for a single application and is then replaced. In applications of multicomponent cartridges or syringes in medicine, however, the tendency is toward single use. The advantage is that a possible contamination of the patient is prevented since an application for a single patient respectively a single treatment can be ensured.

The dispensing devices discussed above have a cartridge with a closure that has to be removed prior to their application in order to be able to attach the mixer. This applies especially also to U.S. Pat. Nos. 4,690,306; 5,301, 842; DE-A-34 20 323; EP-A2-0 319 135; and DE-A-101 32 417, all of which further comprise more or less complicated valve arrangements for preventing the outflow of materials when reused.

SUMMARY OF THE INVENTION

For single use in the medical field, such dispensing devices are too demanding both economically and with respect to time aspects, and it is consequentially the object of the present invention to provide a dispensing device that is both economical to manufacture and simple and quick but above all safe to handle.

The object is attained with a dispensing device wherein the cartridge or syringe and the mixer form an interconnected unit and the closure that is arranged between the outlets of the cartridge and the inlets of the mixer is configured as a valve arrangement in order to establish a connection between the cartridge outlets and the mixing elements of the mixer after performing a relative movement between the mixer and the cartridge or syringe.

Further advantages and solutions are defined in the dependent claims.

BRIEF DESCRIPTION OF THE DRAWINGS

The invention will be explained in more detail hereinafter with reference to schematic drawings of exemplary embodiments, wherein FIGS. 24 to 30 show a variant e.g. of the embodiment according to FIGS. 17 to 23, and FIGS. 31 to 36 show another exemplary embodiment in the open and in the closed condition.

DETAILED DESCRIPTION OF THE INVENTION

Figure 1A:
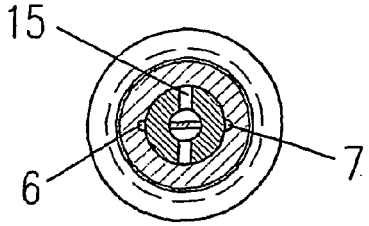
FIG. 1*a* is a cross-section according to the section line in FIG. 1, FIGS. 2 and 2*a* show the device according to FIG. 1 in the open condition.
Figure 1:
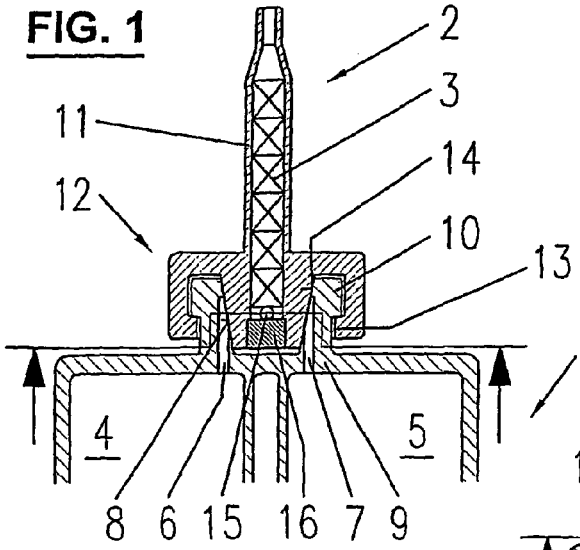
FIG. 1 shows a sectional view of a first exemplary embodiment of a device according to the invention in the closed condition.

FIG. 1 illustrates a double cartridge or syringe 1, hereinafter cartridge, and mixer 2 with mixing elements 3. The two storage containers 4 and 5 have respective outlets 6 and 7 opening onto a conical sealing surface 8 of outlet end 9 of the cartridge. As appears in FIG. 1, outlet end 9 has a circumferential collar 10.

Mixer 2 has a housing 11 whose lower portion is in the form of a bell-shaped inlet section 12 having a circumferential step 13 or several steps 13 at its cartridge side end in order to engage behind circumferential collar 10 at the outlet end and to secure the mixer to the cartridge in such a manner that the mixer is no longer detachable from the cartridge without damaging components.

Figure 2A:
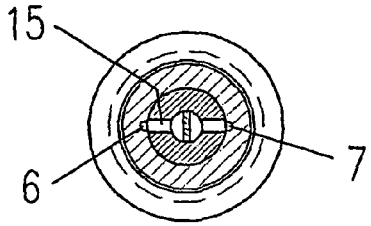
Figure 2:
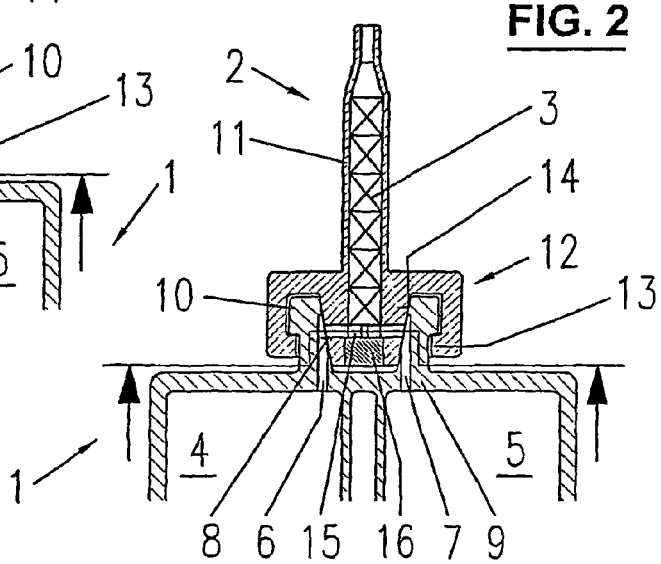
Figure 4A:
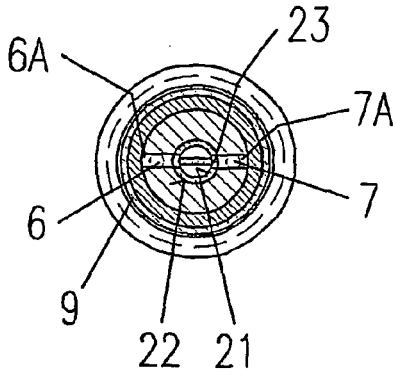

Inlet section 12 of the mixer comprises a cone 14 at its end on the cartridge side that corresponds to conical internal surface 8 at the outlet end in order to provide a tight seal. As appears particularly in a comparison of FIGS. 1*a* and 2*a*, cone 14 on the mixer comprises a transversal bore 15 that is located at the height of outlets 6 and 7 in the assembled condition. A comparison of FIGS. 1, 1*a* and 2, 2*a* further shows that in FIG. 1, the passage from the cartridge outlets to the mixer inlet is closed whereas after a rotation by 90°, the two outlets are connected to each other such that the components may reach the mixing elements. It is further visible in FIGS. 1 and 2 that the cavity formed by the interior of mixer housing 11 is sealed at its cartridge side end by a closure 16 such that the cavity extends down to transversal bore 15.

The cartridge or syringe is supplied in the filled and closed state. For its application it is sufficient to rotate the mixer 90° with respect to the cartridge so that the two components can be mixed and dispensed.

Figure 3A:
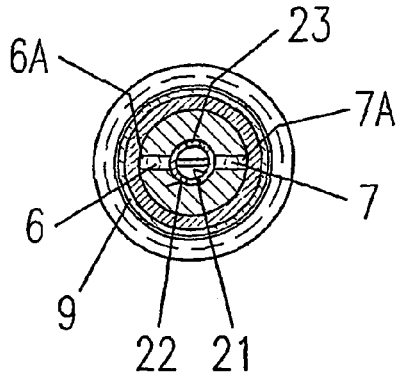
FIGS. 3 and 3*a* and FIGS. 4 and 4*a* show a second exemplary embodiment in the closed and in the open condition.
Figure 3:
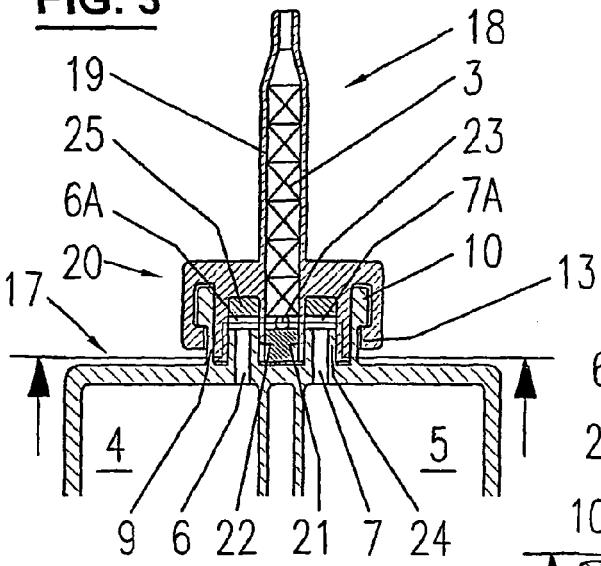
Figure 4:
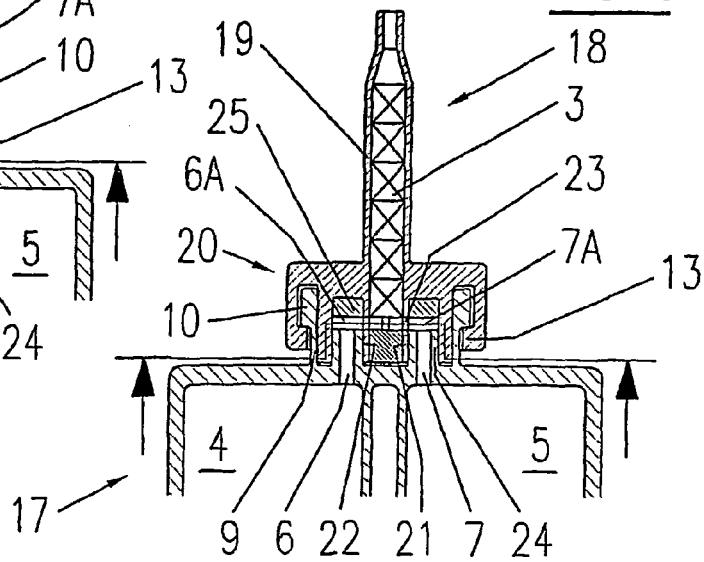
Figure 6A:
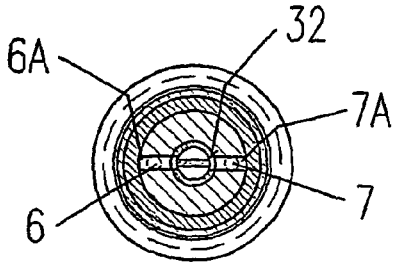

In the embodiment variant according to FIGS. 3 and 4, instead of a conical seal between the mixer and the cartridge, a cylindrical arrangement is used while the principle of the rotary closure remains the same. Cartridge 17 has the same storage containers 4 and 5 and outlets 6 and 7 with transversally extending outlet channels 6*a*, 7*a* while outlet end 9 is provided with the same circumferential collar 10 for receiving circumferential step 13 on mixer 18. Mixer 18 has a housing 19 with inlet section 20 on which circumferential step 13 is provided. However, it is also possible to combine conical and cylindrical surfaces on the mixer inlet end and correspondingly on the cartridge outlet.

Both the outlet end and the inlet section of the mixer have mutually complementary cylindrical internal surfaces 21, 22, cylinder 22 of mixer 18 having a transversal bore 23 in order to establish a connection between the two outlets 6 and 7 of the cartridge, thereby allowing the components to reach the mixing elements. The two outlets 6 and 7 are arranged in an annular portion 24, and outlet channels 6*a*, 7*a* are sealed on the mixer side by a sealing ring 25 placed in the mixer inlet section.

A comparison of FIGS. 3, 3*a* and 4, 4*a* shows that by rotating the mixer with respect to the cartridge by 90°, the connection between outlet channels 6*a*, 7*a* and mixing elements 3 is established.

Figure 5A:
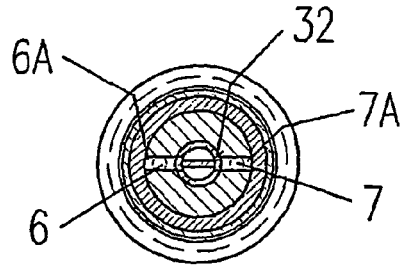
FIGS. 5 and 5*a* and FIGS. 6 and 6*a* show a third exemplary embodiment in the closed and in the open condition.
Figure 5:
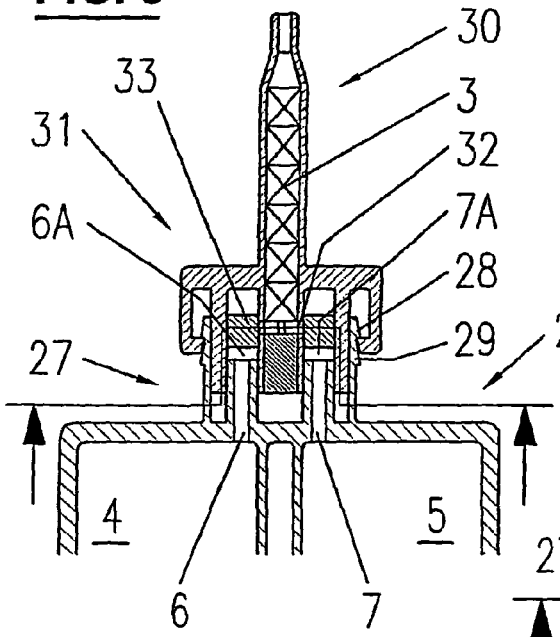
Figure 6:
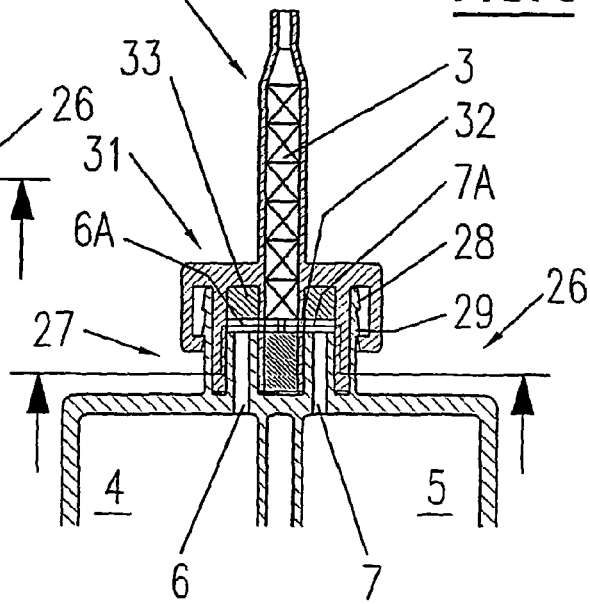

In the following exemplary embodiments, the mixer is no longer rotated with respect to the cartridge but displaced toward the cartridge in an axially guided manner. Cartridge 26 of FIG. 5 comprises the same storage chambers 4 and 5 and outlets 6 and 7, each of which leads to transversally extending outlet channels 6*a* and 7*a*. Outlet end 27 is provided with two circumferential, saw tooth like retaining collars 28 and 29 engaging behind circumferential step 13 on inlet section 31 of mixer 30. The prolongation of the mixer inlet section on the cartridge side end thereof has a through-going inlet 32 arranged at such a distance from the end that it communicates with outlet channels 6*a* and 7*a* of the cartridge in the open condition according to FIG. 6. In this condition, circumferential step 13 on the mixer inlet section engages behind the second collar 29 on the cartridge side of outlet end 27 of the cartridge. Consequently, in the open condition also, the mixer is firmly secured to the cartridge in such a manner that it cannot be detached therefrom without destroying the components. In the inlet section of the mixer, a sealing ring 33 is arranged that seals outlet channels 6*a* and 7*a* at the top in order to ensure a correct seal both in the closed and in the open condition.

However, it is also possible in this embodiment variant to arrange the mixer inlet and correspondingly the outlet channels of the cartridge in such a manner that the mixer inlet is located on the cartridge side, and to establish the connection between the cartridge and the mixer by retracting the mixer in the outlet direction.

FIGS. 7 to 10 illustrate another embodiment variant where the mixer is axially displaced with respect to the cartridge. Cartridge 34 comprises the same storage containers 4 and 5 as well as outlets 6 and 7 while outlet end 9 has a circumferential collar 35 behind which circumferential step 13 of the mixer inlet section engages. In the inlet section of mixer 36, a closure member 37 having two closure plugs 38 and 39 is arranged, the latter fitting into outlets 6 and 7 in the closed condition according to FIG. 7 in order to seal them. On closure member 37, two cylindrical guide members 40 are arranged which enclose mixer outlets 6 and 7. At its cartridge side end, the mixer inlet section is provided with the circumferential step 13 that prevents that the mixer can be withdrawn from the cartridge. Closure member 37 with closure plugs 38 and guide cylinders 40 may be produced in one piece.

Figure 7:
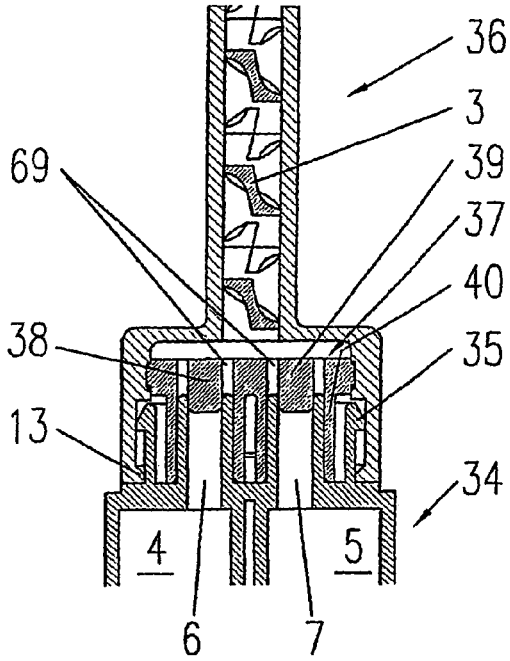
FIGS. 7 to 10 show a sectioned side elevation of another exemplary embodiment in the closed and in the open condition.
Figure 8:
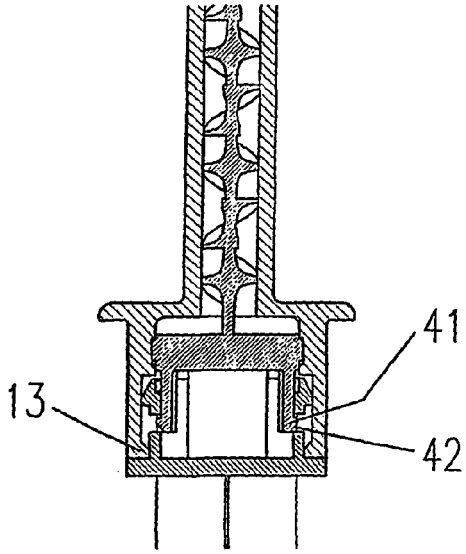
Figure 9:
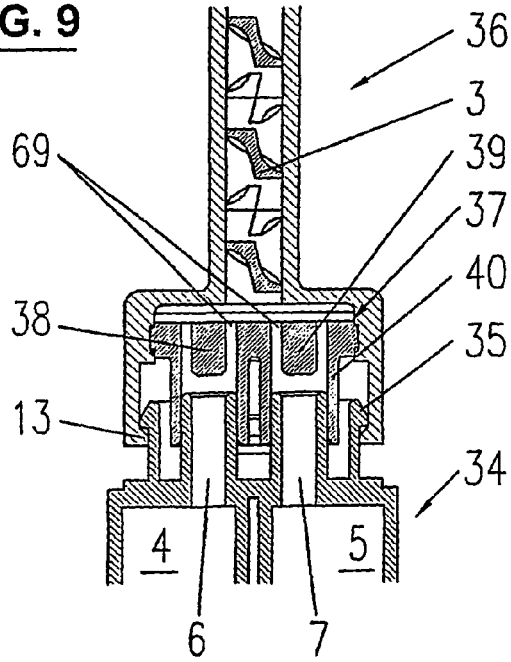
Figure 10:
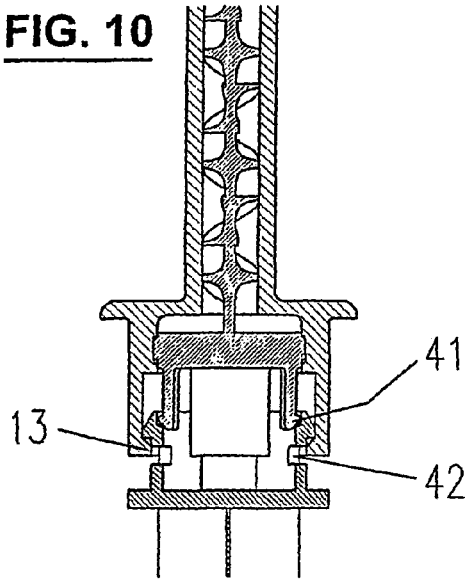

A comparison of FIGS. 7 and 9 shows that after axially displacing the mixer, the two closure plugs 38 and 39 have been withdrawn from the mixer outlets so that the components may reach mixing elements 3 through inlets 69 arranged around the closure plugs. From lateral views of FIGS. 8 and 10 it follows that the end of closure member 37 is provided with retaining noses 41 which in the closed condition engage in corresponding openings 42 in outlet end 9 of the cartridge. In the open position of FIG. 10 it is further apparent that the circumferential step 13 at the mixer end engages behind collar 35.

Figure 11:
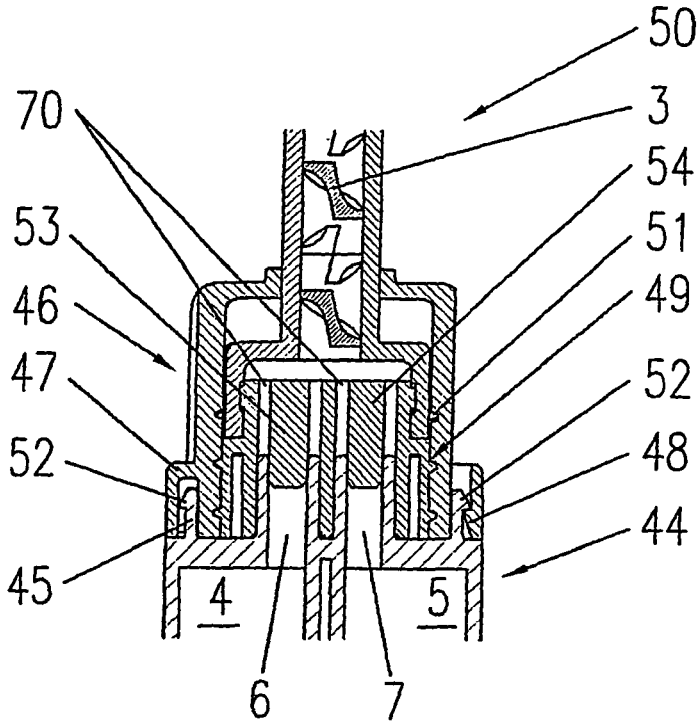
FIGS. 11 and 12 show another exemplary embodiment in the closed and in the open condition.
Figure 12:
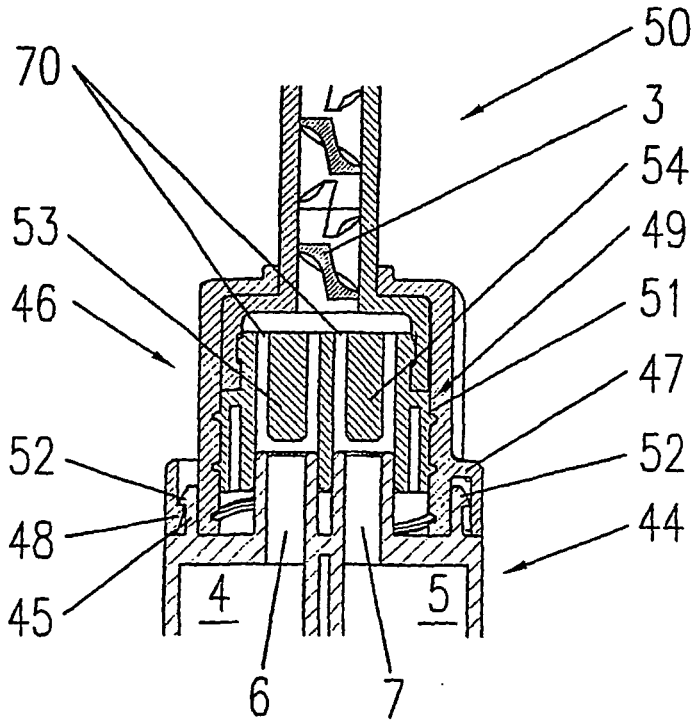

In the embodiment variant according to FIGS. 11 and 12, the mixer is axially moved away from the cartridge by means of a screw thread to release the outlets. At its outlet end 9, cartridge 44 with storage containers 4 and 5 as well as outlets 6 and 7 is provided with a retainer 45 having a bead 52 for a threaded ring having an internal thread 46 and whose end portion 47 encloses retainer 45 and is externally provided with snap noses 48.

The external surface of closure member 49 of the inlet section of mixer 50 is correspondingly provided with an external thread 51 that cooperates with the internal thread of the threaded ring. Closure member 49 is engaged in the mixer housing and has two closure plugs 53 and 54 fitting into outlets 4 and 5. Partly arranged around the closure plugs are inlet channels 70 for the components through which the components reach the mixing elements.

From the comparison of FIGS. 11 and 12 it becomes apparent that by rotating threaded ring 46, closure member 49 is lifted off from the cartridge along with the mixer housing and the closure plugs liberate the two outlets of the cartridge.

FIGS. 13 to 16 show another embodiment variant whose cartridge 55 has the two storage containers 4 and 5 as well as outlets 6 and 7. The two retainers 56 at the outlet end of the cartridge comprise respective retaining noses 57 which engage behind the circumferential step 13 on the cartridge side of the mixer inlet end in order to non-detachably retain mixer 58. As follows from FIG. 14 or 16, the retainers on outlet end 9 are arranged in two opposite locations.

Figure 13:
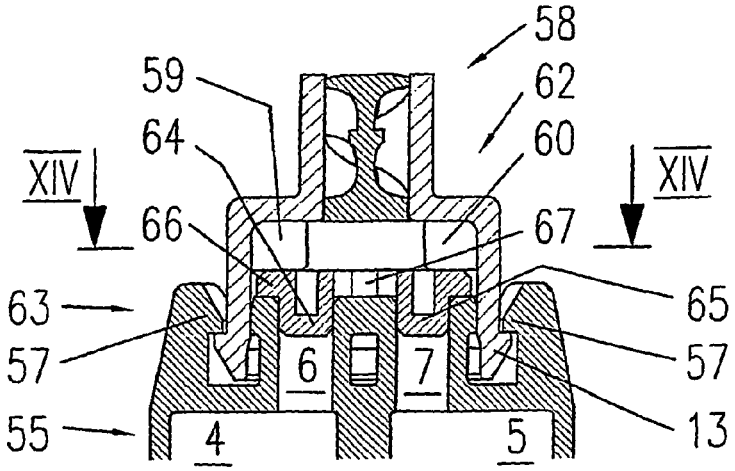
FIGS. 13 to 16 show another exemplary embodiment in the closed and in the open condition.
Figure 14:
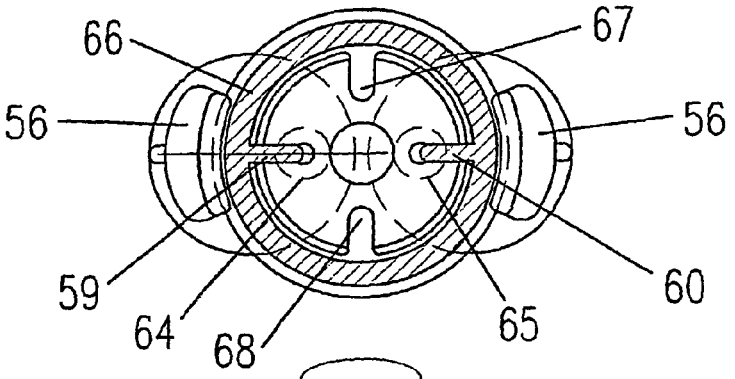
Figure 15:
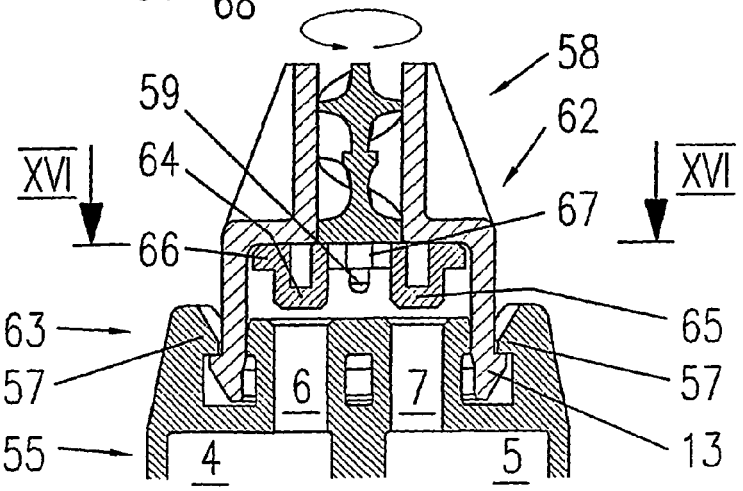

Mixer inlet section 62 has two opposite downholding ridges 59 and 60 holding down a closure composed of a closure disk 66 on which two closure plugs 64 and 65 of a soft material are arranged, as shown in FIG. 13. The closure disk further comprises two slots 67 and 68 whose width corresponds to the thickness of the downholding ridges.

Figure 16:
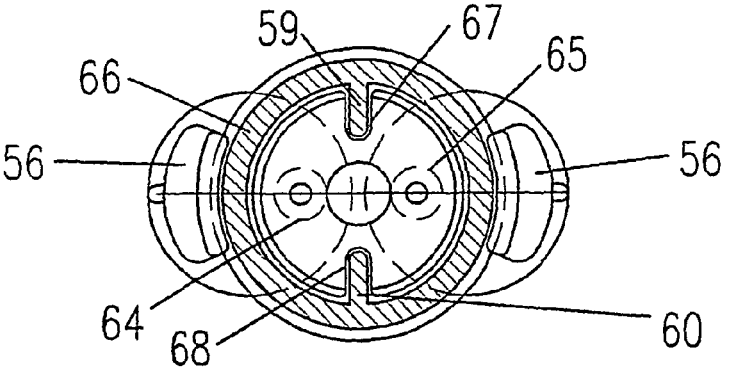

After a rotation by 90° up to a stop, downholding ridges 59 and 60 are in the released position according to FIG. 16 and are located above slots 67 and 68 in the closure disk, thereby allowing the closure to be opened. As the components are dispensed, the closure plugs on the closure are pushed out of the outlet channels and the cartridge is thus opened, i.e. in the position of FIG. 15.

Figure 17:
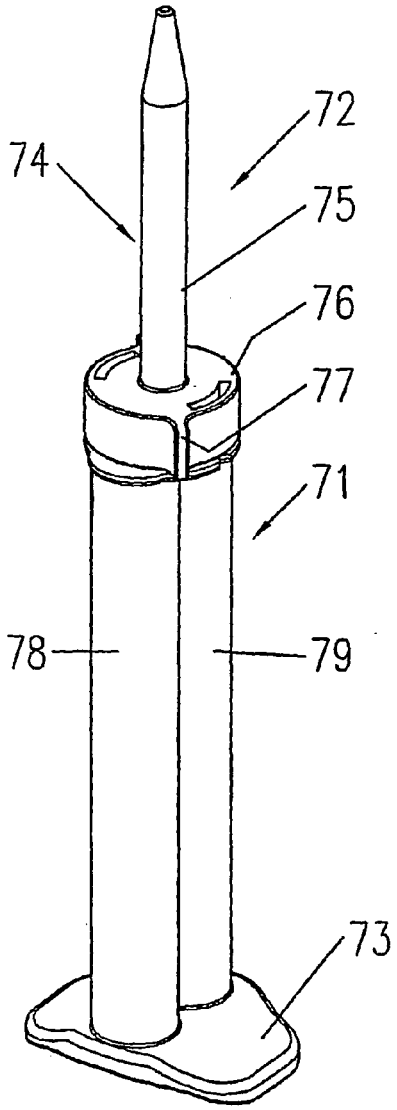
FIGS. 17 to 23 show another exemplary embodiment in the closed and in the open condition.

In FIGS. 17 to 23, another exemplary embodiment is illustrated where a joint of an elastomeric material is arranged between the double cartridge and the mixer. FIG. 17 shows the new exemplary embodiment with double cartridge 71 and mixer 72 in a lateral view, the double cartridge having a flange 73 that serves either as a fastening flange if the double cartridge is pushed into a dispensing appliance, or as a retaining flange if the thrust rods are directly actuated manually. Of mixer 72, housing 74 with tubular portion 75 and fastening portion 76 with two wings 77 is visible. Double cartridge 71 further comprises two storage containers 78 and 79.

Figure 18:
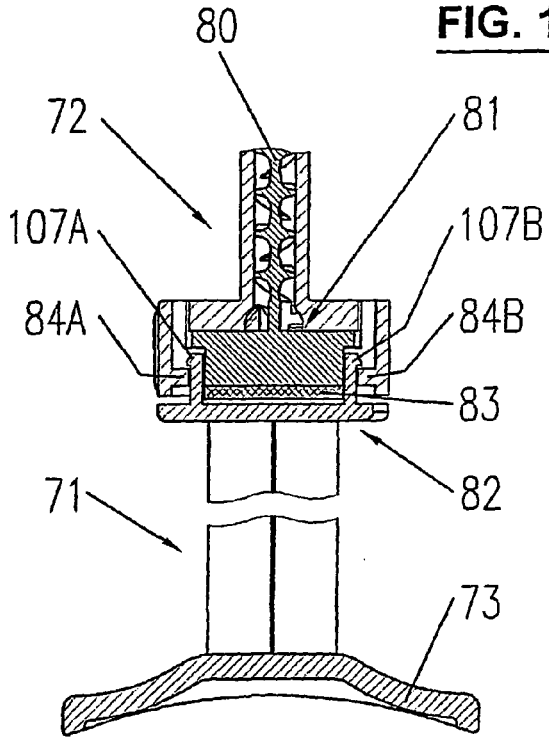
Figure 22:
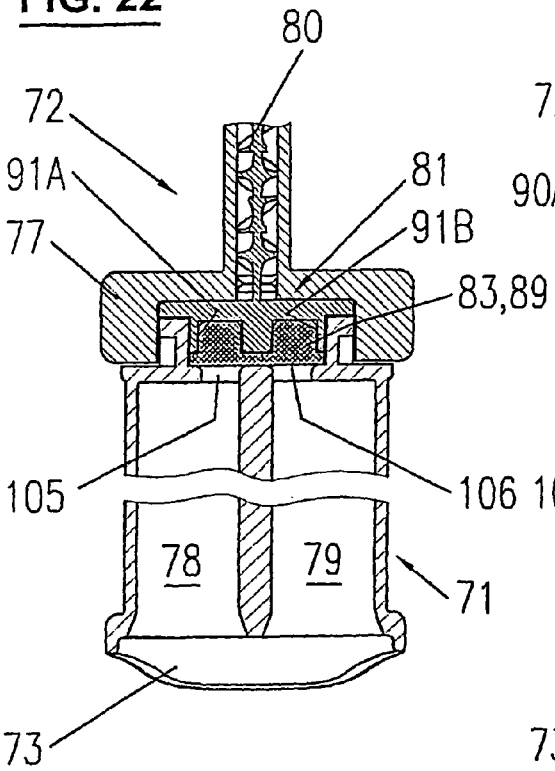
Figure 23:
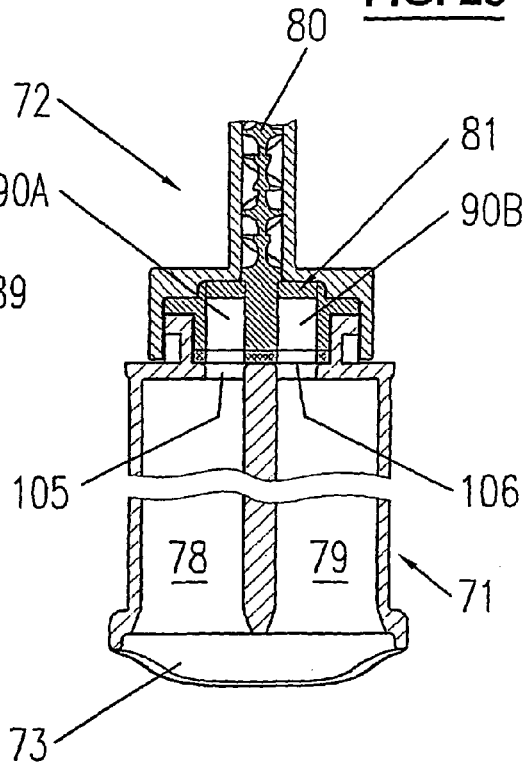
Figure 22A:
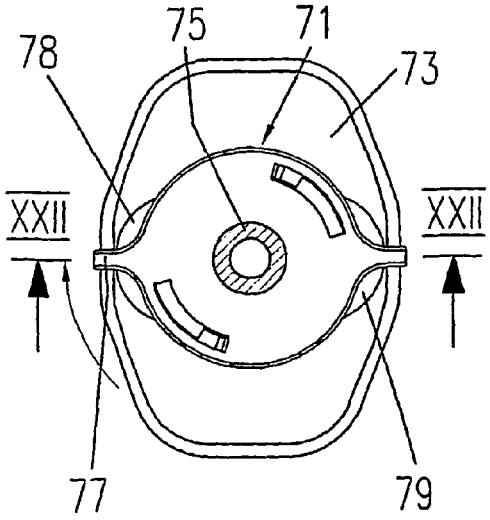
Figure 23A:
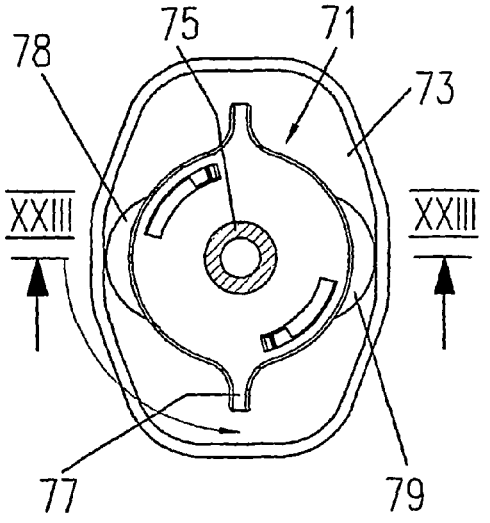

The sectional view of FIG. 18 shows the mixer after having been attached to the cartridge while the illustration of FIG. 22 shows the mixer after a clockwise rotation by 45°, whereby the mixer is locked with the cartridge, and FIG. 23 shows the latter after a backward rotation in the counterclockwise direction by 90°, whereby the mixer is locked and secured against rotation.

The sectional view of FIG. 18 shows that mixing elements 80 in mixer housing tube 75 and mixer inlet section 81 are integrally formed. Between mixer inlet section 81 and cartridge outlet section 82 a sealing disk 83 is arranged that is illustrated in FIG. 21 and consists of a suitable elastic and self-restoring material.

Figure 21:
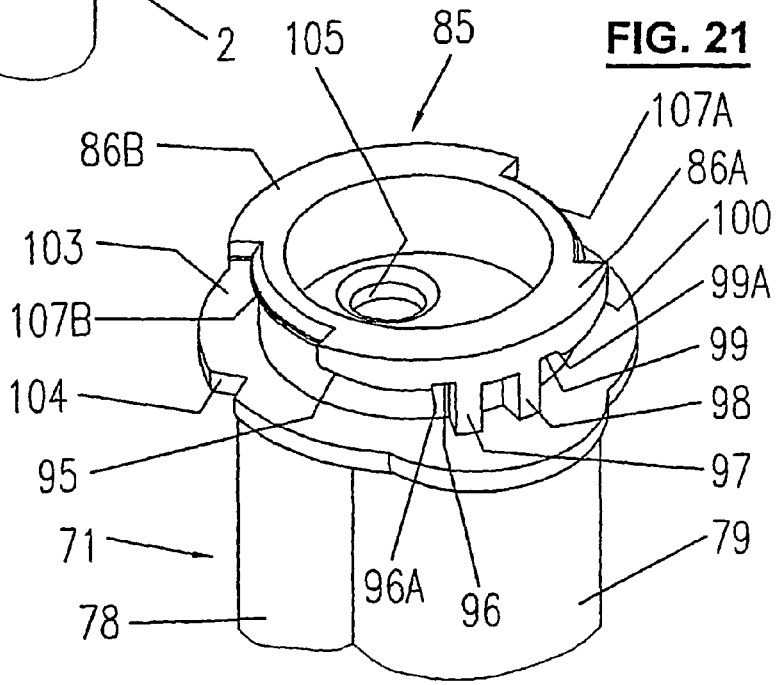

As already mentioned, FIG. 18 shows the mixer attached to the cartridge by snap action while bayonet tabs 84A and 84B on the mixer, see also FIG. 22, engage behind recesses 107A, 107B in bayonet ring 85 on the cartridge, which are designed as snap tongues, see also FIG. 21.

Figure 18A:
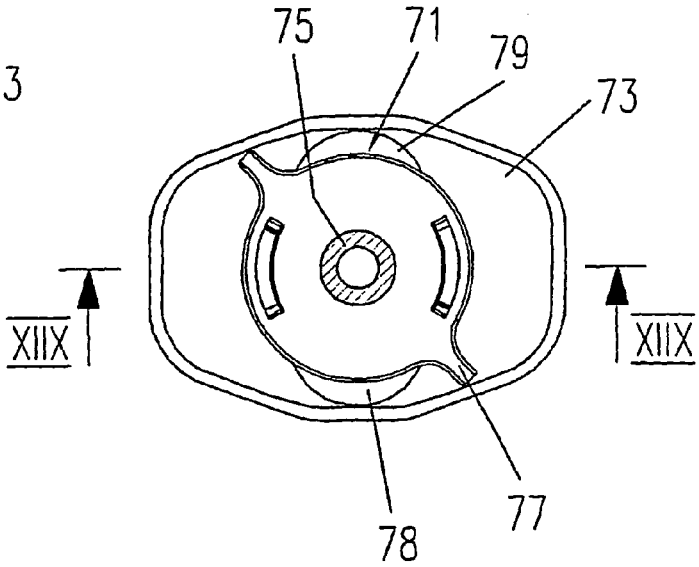

In the top view of FIG. 18*a*, flange 73 as well as the two storage containers 78 and 79 of the cartridge are visible and, of mixer 72, mixer tube 72 with fastening portion 76 and its two wings 77 and the two bayonet tabs 84A and 84B, which are visible through an unmolding opening.

Figure 19:
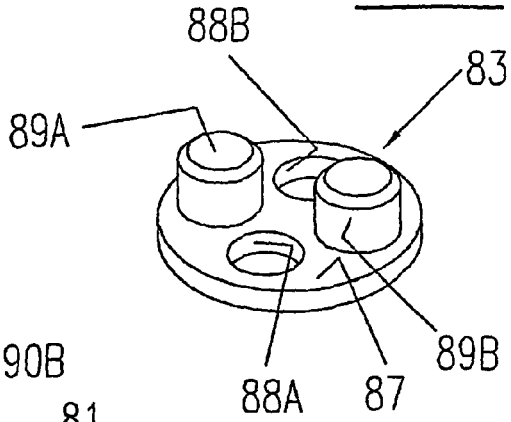

FIG. 19 illustrates sealing disk 83 that serves as a rotary slide valve and consists of a disk 87 having two opposed passages 88A and 88B and two driving pegs 89A and 89B arranged thereon.

Rotary slide valve seal 83 is placed on mixer inlet section 81 that has corresponding passages 90A and 90B as well as recesses 91A and 91B for driving knobs 89A and 89B. The fastening portion of the mixer housing further comprises two stop noses 92 and 93 that serve for positioning a correspondingly shaped inlet flange 94 of mixer inlet section 81.

In FIG. 21, the cartridge outlet with locking flange 85 and the two bayonet locking members 86A and 86B is visible. On its side facing the cartridge, the bayonet locking portion has a tightening surface 95 that is directed toward the cartridge and has an adjacent recess 96 followed by two stop ridges 97 and 98, stop ridge 98 being followed by a second recess 99 that belongs to tightening surface 100. While edge 96A of recess 96 is sharp-edged on the side of tightening surface 95, edge 99A between recess 99 and tightening surface 100 is beveled.

Figure 20:
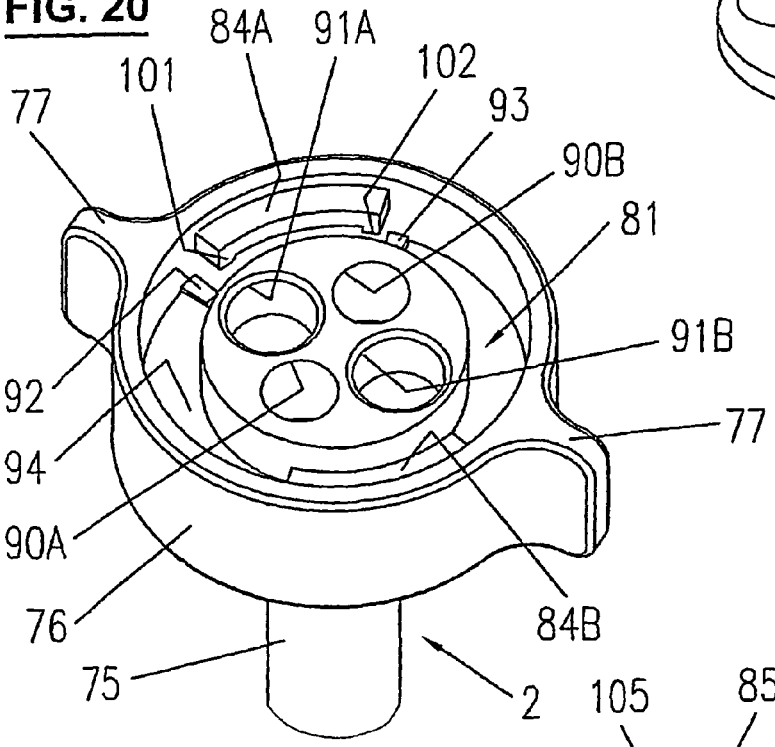

The parts on bayonet tabs 84A or 84B that correspond to recesses 96 and 99 are two steps 101 and 102 that are arranged according to FIG. 20 on the bayonet tab side facing the mixing elements. The result of the different design of edges 96A and 99A is that step 101 can still be rotated out of recess 99 after a clockwise rotation of the mixer by 45°, i.e. that the mixer can be rotated in the counterclockwise direction until step 101 engages in recess 96A and the mixer can therefore no longer be turned back. Cartridge outlet flange 103 is provided with a notch 104 that serves for visually coding the cartridge so that the latter is inserted in a dispensing appliance in a defined position.

As already mentioned, in FIGS. 18 and 18*a*, respectively, the mixer has been placed on the cartridge and snapped in, and in the illustration of FIG. 22, the mixer has been rotated 45° in the clockwise direction as symbolized by arrow C in FIG. 22. In this position, step 101 on bayonet tab 84A engages in recess 99A in locking portion 86A in order to lock and secure the mixer on the cartridge. In FIG. 22 it is apparent that in this position, outlets 105 and 106 of the cartridge are sealed by sealing disk 83. The filled cartridge or the syringe including the mixer is thus ready for shipment.

In the position of FIG. 23, the mixer has been rotated by 90° in the counterclockwise direction with respect to the position of FIG. 22, as shown by arrow O. In this position, steps 102 on the bayonet tabs of the mixer engage in sharp-edged recess 96 in such a manner that the mixer can no longer be turned back without applying destructive force. It is thus ensured that the double cartridge or syringe can no longer be reclosed or reused after use. In FIG. 23 it is visible that passages 90A and 90B in the sealing disk coincide with outlets 105 and 106 of the cartridge so that the material can be dispensed via the mixer.

Figure 24:
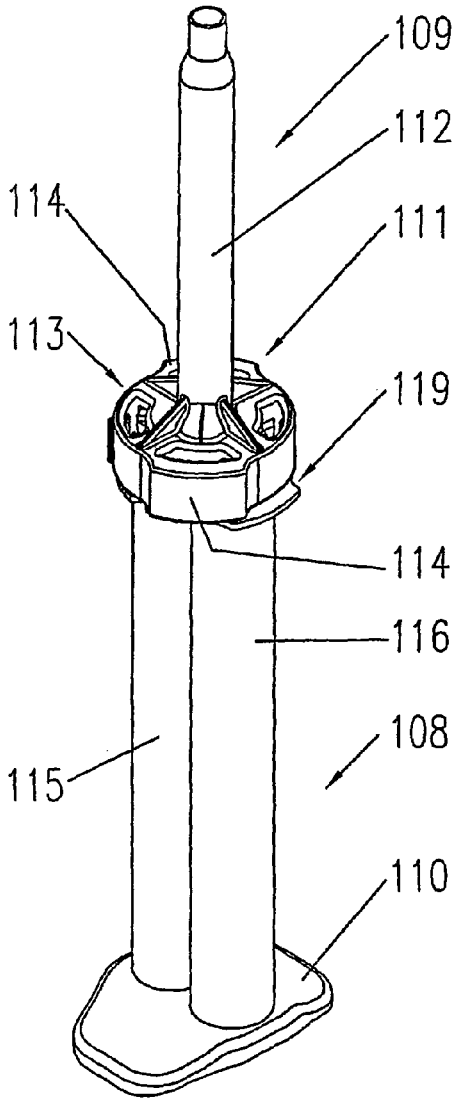

In FIGS. 24 to 30, a variant of the preceding exemplary embodiment is illustrated. FIG. 24 shows double cartridge 108 and mixer 109 in a lateral view, the double cartridge having a flange 110 that serves either as a fastening flange if the double cartridge is pushed into a dispensing appliance, or as a retaining flange if the thrust rods are directly actuated manually. Of mixer 109, housing 111 with tubular portion 112 and fastening portion 113 with two wings 114 is visible. Double cartridge 108 further comprises two storage containers 115 and 116.

Figure 25:
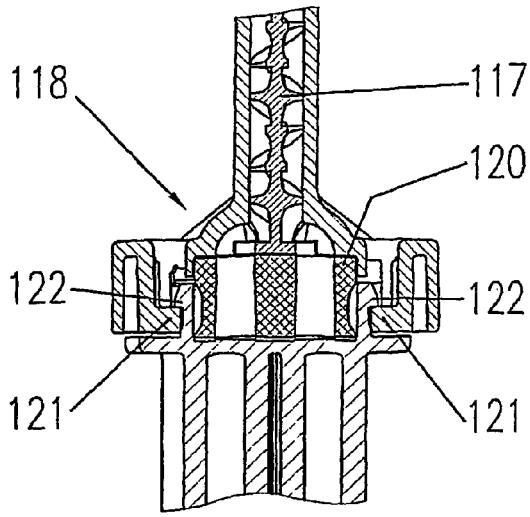

The sectional view of FIG. 25 shows the mixer after it has been attached to the cartridge while the illustration of FIG. 29 shows the fastening portion of the mixer after a clockwise rotation by 45°, whereby the mixer is in firm engagement with the cartridge and the outlets are closed, and FIG. 30 shows the latter after a backward rotation by 90° in the counterclockwise direction, whereby the outlets are opened but the mixer is secured against rotation.

The sectional view of FIG. 25 shows that mixing elements 117 are arranged in mixer housing tube 112 after mixer inlet section 118. Between mixer inlet section 118 and cartridge locking flange 119 a sealing disk 120 is arranged that is illustrated in FIG. 26 and consisting of a suitable elastic and self-restoring material such as silicone or polyurethane.

Figure 28:
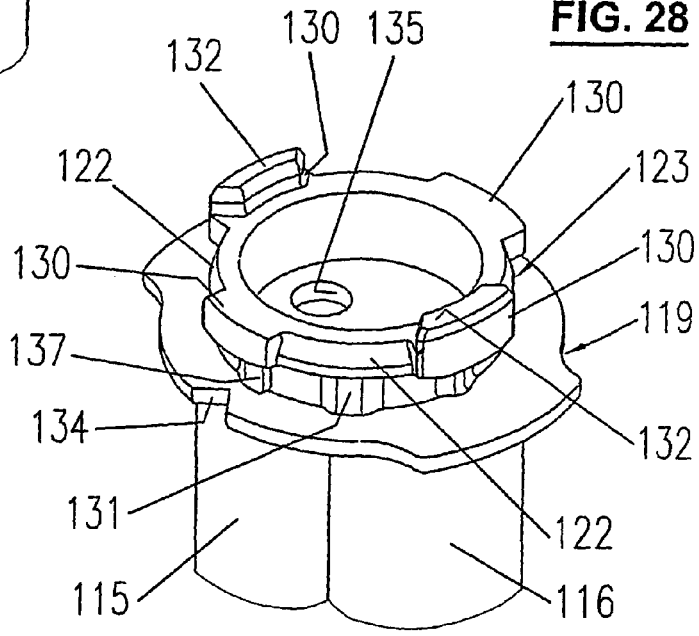

As already mentioned, FIG. 25 shows the mixer attached to the cartridge by snap action while bayonet tabs 121 of the mixer, see also FIG. 29, engage behind recesses 122 in bayonet ring 123 on the cartridge, which are designed as snap tongues, see also FIG. 28.

Figure 25A:
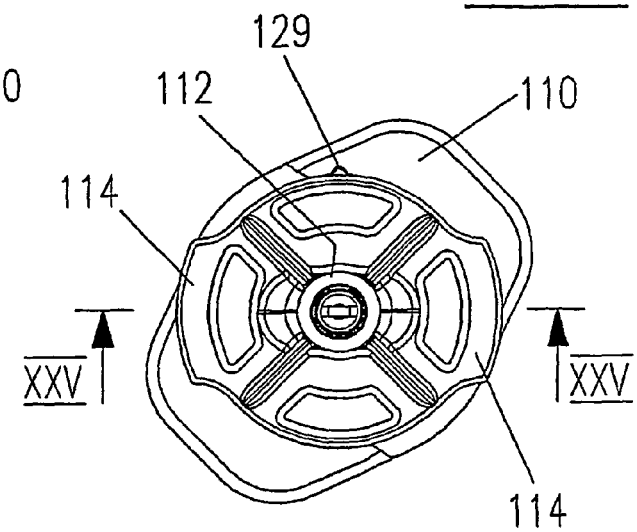

In the top view of FIG. 25A, flange 110, the two storage containers 115 and 116 of the cartridge and, of mixer 109, mixer tube 112 with fastening portion 113 and its two wings 114 as well as a positioning nose 129 are visible.

Figure 26:
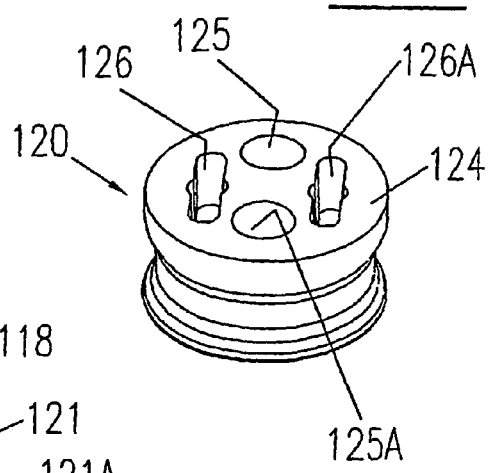
Figure 27:
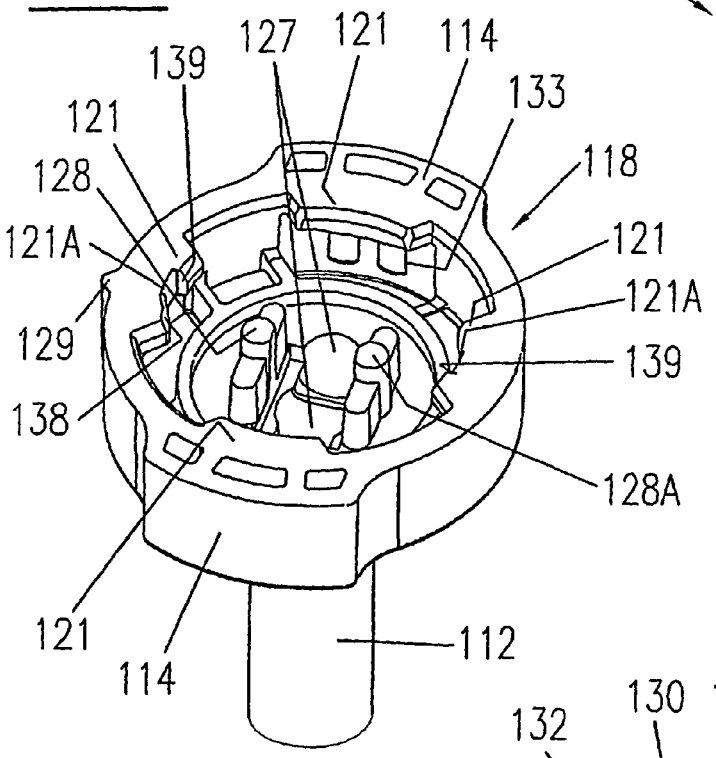

FIG. 26 illustrates sealing disk 120 that consists of a disk 124 having two opposed passages 125 and 125A and two driving apertures 126 and 126A in the form of grooves with a bore arranged therein.

Sealing disk 120 is placed on mixer inlet section 118 that has corresponding passages 127 and 127A as well as two driving ridges that are shaped according to the driving apertures and provided with pressure pegs 128 and 128A, and bayonet tabs 121. The pressure pegs, which are made slightly longer than the bore and arranged in the center of the driving ridges, press the joint against the cartridge outlets in the closed position.

In FIG. 28, the cartridge outlet end with locking flange 119 and bayonet noses 130 and projections 131 on bayonet ring 123 is visible. The bayonet noses have the usual tightening surfaces that are facing and directed toward the cartridge. A limitation of the bayonet action during locking and opening is provided by two stops 132 on two opposed bayonet noses which cooperate with corresponding stop surfaces 133 in the mixer inlet section.

Furthermore, bayonet ring 123 is provided in addition to projections 131, which are not sharp-edged but beveled, with two stop cams 137 having straight edges. Projections 131 and stop cams 137 cooperate with incisions 121A that are formed in bayonet tabs 121 of the mixer. These incisions have a bevel 138 on one side and a sharp edge 139 on the other side.

These locking means still allow the mixer to be rotated out of projections 131 after a clockwise rotation by 45°, i.e. the mixer can be rotated in the counterclockwise direction by 90° but can no longer be turned back as the sharp edges 139 are now abutting to stop cam 137.

As already mentioned, in FIGS. 25 and 25*a*, respectively, the mixer has been placed on the cartridge and snapped in, and in the illustration of FIG. 29, the mixer has been rotated by 45° in the clockwise direction. In FIG. 29 it is apparent that in this position, outlets 135 and 136 of the cartridge are sealed by sealing disk 120. The filled cartridge or syringe including the mixer is thus ready for shipment.

In the position of FIG. 30, the mixer has been rotated by 90° in the counterclockwise direction with respect to the position of FIG. 29. As already described, the mixer engages in this position in such a manner that it can no longer be turned back without applying destructive force. It is thus ensured that the double cartridge or syringe can no longer be reclosed or reused after use. In FIG. 30 it is further visible that passages 125 and 125A in the sealing disk coincide with outlets 135 and 136 of the cartridge so that the material can be dispensed via the mixer.

Figure 31:
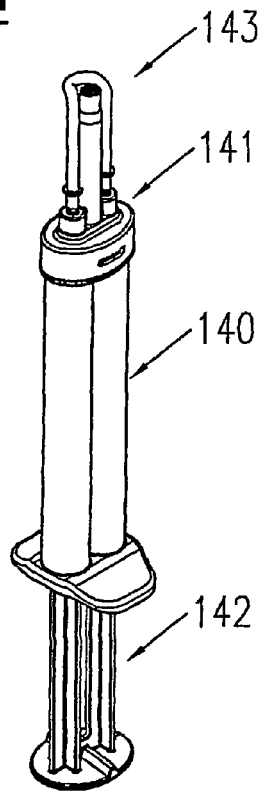
Figure 32:
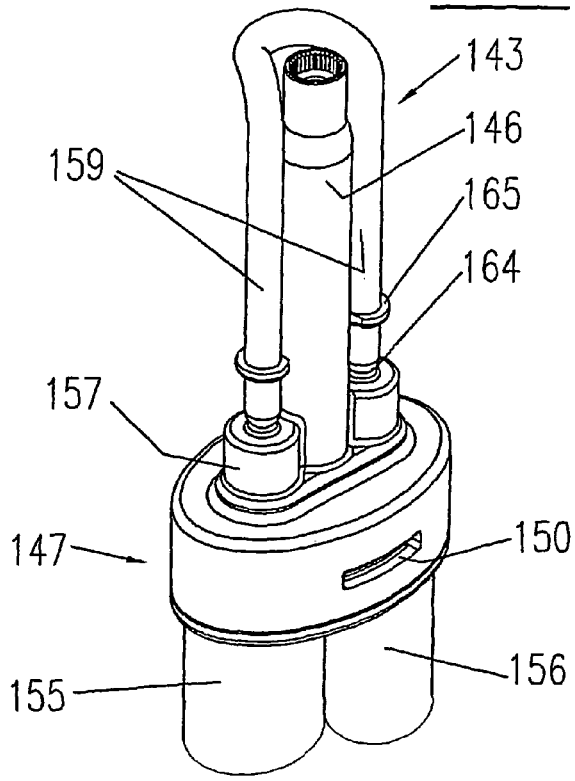

FIGS. 31 to 36 illustrate an exemplary embodiment in which the inlets of the mixer are connected to the outlets of the syringe by withdrawing a closure loop. FIG. 31 illustrates a dispensing assembly including a double syringe 140, a mixer 141, thrust rods 142, and a closure loop 143 in a perspective view and in the open position. In the exploded view of FIG. 33, these parts are shown separately, and in FIG. 32, syringe outlet end 144 and the closure loop are shown on an enlarged scale.

Figure 33:
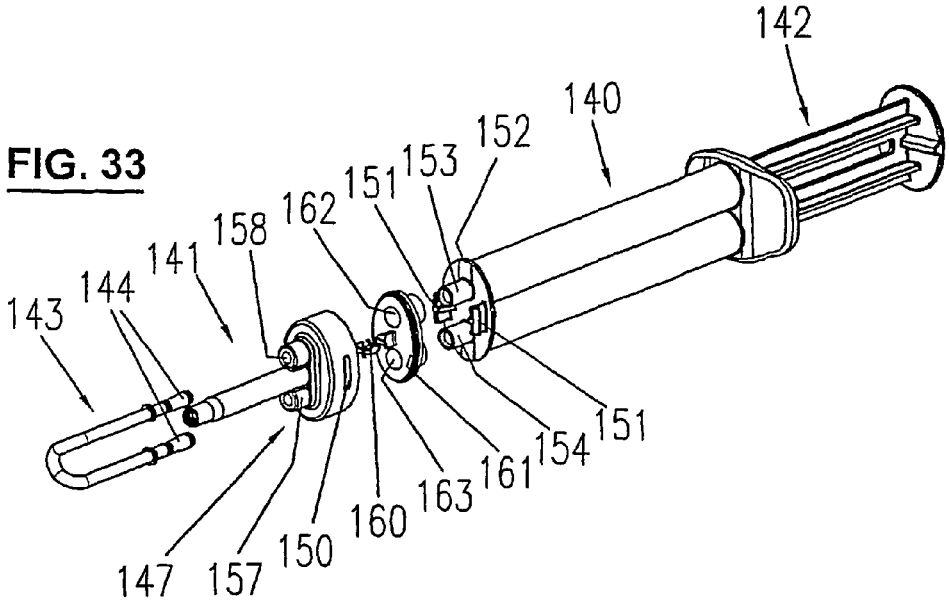

According to FIG. 33, mixer 141 comprises a mixer tube 146 and an inlet housing 147 in which snap openings 150 are arranged which serve for receiving snap tongues 151 on cartridge outlet flange 152. Furthermore, the two outlets 153 and 154 of storage containers 155 and 156 in the form of nipples are arranged on the outlet flange.

The mixer inlet housing further comprises two guiding sleeves 157 having each a conical bore 158 that tapers on the inlet side and serves for receiving a corresponding conical closure plug 144 at end of shank 159 of closure loop 143. The mixer further includes a mixing helix 160 provided on the syringe side with an inlet flange 161 that has two passages 162 and fits into mixer inlet housing 147. On its syringe side, the inlet flange has two inlets 163 and 164.

Figure 34:
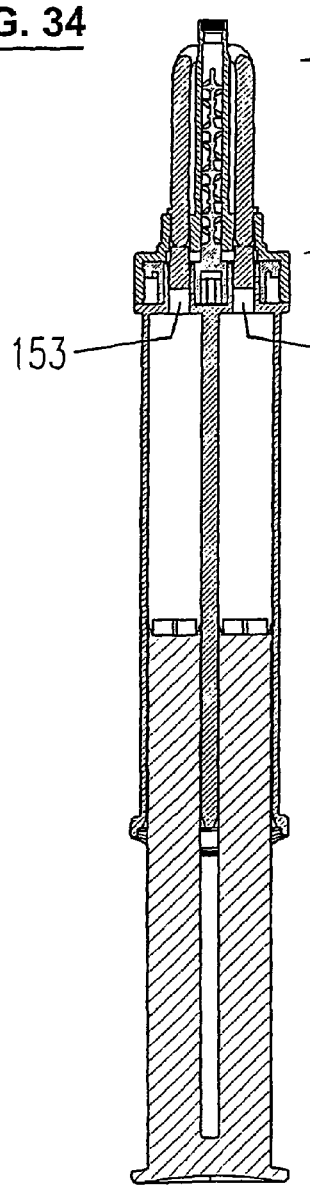
Figure 35:
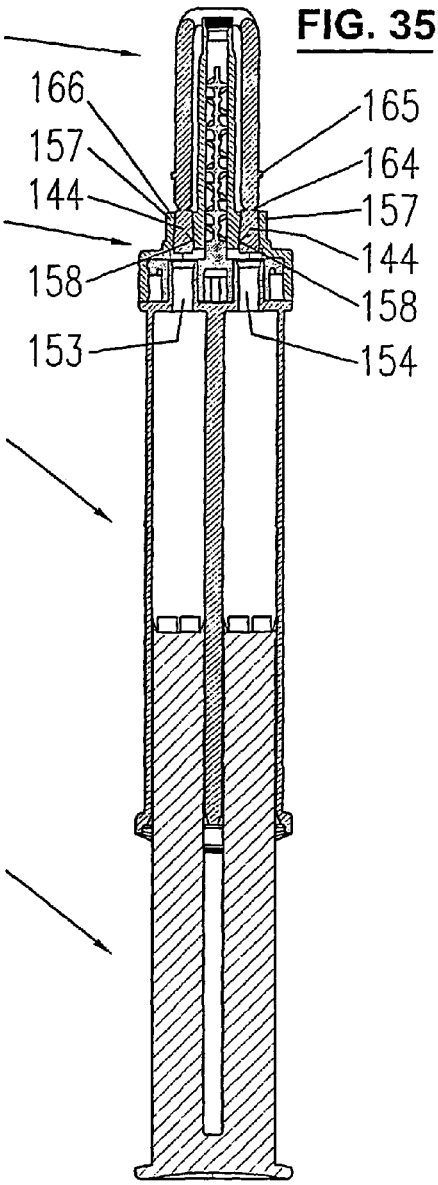
Figure 36:
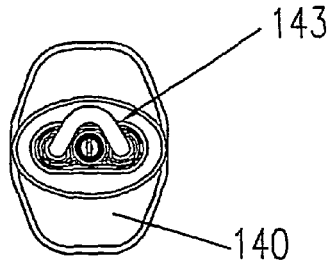

Behind closure plug 144 of each shank 159 there is a constriction 164 as well as at some distance a collar 165, see FIGS. 34 and 35. In the closed position of FIG. 34, the closure loop is pushed both trough bores 158 of guiding sleeve 157 and through the passages respectively outlets 162, 163 of the syringe up to its collar 165. In the open position of FIG. 35, closure loop 143 has been pulled out until conical closure plugs 144 sit tight in conical bores 158 of the guiding sleeves. The constrictions are shaped such as to form a rupture point where the closure loop can be snapped off and removed. Alternatively, a concentric opening ring may be used instead of the closure loop.

What is claimed is:

1. A dispensing device, comprising:

a mixer, wherein the mixer includes an inlet section and a plurality of mixing elements; and at least one of a multicomponent cartridge and syringe with a closure, wherein the closure is arranged between a first outlet and a second outlet of the at least one of the multicomponent cartridge and syringe and the mixer;

wherein the at least one of the multicomponent cartridge and syringe and the mixer form an interconnected unit, wherein the closure is configured to block a fluidly connecting passage that is positioned between the inlet section and the first outlet and the second outlet of the at least one of the multicomponent cartridge and syringe and wherein the closure is configured to allow access, after a relative movement occurs between the mixer and the at least one of the multicomponent cartridge and syringe, to the fluidly connecting passage, wherein the first outlet and the second outlet of the at least one of the multicomponent cartridge and syringe are arranged in an outlet end and the outlet end includes a circumferential collar behind which a circumferential step of the mixer inlet section engages, whereby the dispensing device is adapted for single use.

2. A dispensing device according to claim 1, wherein the circumferential collar includes a flange on an inner and an outer surface of the outlet end.

3. A dispensing device according to claim 1, wherein the closure is configured to move with the mixer in a direction parallel to a longitudinal axis of the at least one of the multicomponent cartridge and syringe, whereby the closure is adapted to block the fluidly connecting passage when the closure moves in an upward direction and whereby the closure is adapted to allow access to the fluidly connecting passage when the closure moves in a downward direction.

4. The dispensing device according to claim 1, wherein the closure circumferentially extends between the first outlet and the second outlet of the at least one of the multicomponent cartridge and syringe.

5. The dispensing device according to claim 1, wherein the fluidly connecting passage extends in a direction substantially perpendicular to a longitudinal axis of the at least one of the multicomponent cartridge and syringe.

6. The dispensing device according to claim 1, further comprising a sealing ring positioned at an inlet section of the mixer, wherein the sealing ring abuts a first outlet channel that transversally extends from the first outlet of the at least one of the multicomponent cartridge and syringe and abuts a second outlet channel that transversally extends from the second outlet of the at least one of the multicomponent cartridge and syringe.

7. A dispensing device, comprising:

a mixer, wherein the mixer includes an inlet section and a plurality of mixing elements; and at least one of a multicomponent cartridge and syringe with a closure, wherein the closure is arranged between a first outlet and a second outlet of the at least one of the multicomponent cartridge and syringe and the mixer;

wherein the at least one of the multicomponent cartridge and syringe and the mixer form an interconnected unit, wherein the closure and the inlet section form a valve located in the inlet section of the mixer in order to establish a connection between the first outlet and the second outlet and the mixing elements after performing a relative movement between the mixer and the at least one of the multicomponent cartridge and syringe, wherein the first outlet and the second outlet of the at least one of the multicomponent cartridge and syringe are arranged in an outlet end and the outlet end includes a circumferential collar behind which a circumferential step of the mixer inlet section engages, whereby the dispensing device is adapted for single use.

8. The dispensing device according to claim 7, wherein the valve is configured to be opened by a rotation of the mixer with respect to the at least one of the multicomponent cartridge and syringe.

9. The dispensing device according to claim 7, wherein the valve has a transversal bore that establishes a connection between the first outlet and the second outlet of the at least one of the multicomponent cartridge and syringe and the mixing elements after a rotation of the mixer.

10. The dispensing device according to claim 1, wherein the cartridge side end of the mixer is shaped as a cone and/or a cylinder that engages in a corresponding internal surface at the cartridge outlet end.

11. The dispensing device according to claim 7, wherein the valve is configured to be opened by an axial displacement of the mixer with respect to the at least one of the multicomponent cartridge and syringe.

12. The dispensing device according to claim 11, wherein the valve has a transversal bore that establishes a connection between the first outlet and the second outlet of the at least one of the multicomponent cartridge and syringe and the mixing elements after the axial displacement of the mixer.

13. The dispensing device according to claim 11, wherein the valve includes two closure plugs that are removed from the first outlet and the second outlet of the at least one of the multicomponent cartridge and syringe after the axial displacement of the mixer toward the outlet.

14. The dispensing device according to claim 13, wherein the outlet end of the at least one of the multicomponent cartridge and syringe has stop noses that are distanced from the at least one of the multicomponent cartridge and syringe and are engaged after the axial displacement of the mixer toward the outlet by a circumferential step on the cartridge side mixer end.

15. The dispensing device according to claim 14, wherein the inlet section includes a closure member having two cylindrical guide members with retaining noses which in the closed position engage in openings in the outlet end.

16. The dispensing device according to claim 13, wherein downholding ridges which in the closed condition act on a closure including a closure disk with two closure plugs arranged thereon are disposed on the inlet section, the closure disk having two slots such that after rotating the mixer, the downholding ridges are positioned above the slots in order to release the closure on dispensing.

17. The dispensing device according to claim 7, wherein the valve comprises a sealing disk configured as a rotary slide valve with two passages, the sealing disk being inserted in the mixer inlet section such that when the mixer is rotated with respect to the at least one of the multicomponent cartridge and syringe, the passages of the sealing disk, which are always communicating with inlet section, communicate with or seal the first outlet and the second outlet of the at least one of the multicomponent cartridge and syringe.

18. The dispensing device according to claim 17, wherein the mixer is fastened to the at least one of the multicomponent cartridge and syringe by a bayonet lock, wherein adjacent bayonet locking members of the bayonet lock are formed on a mixer fastening portion and on a locking flange of the at least one of the multicomponent cartridge and syringe and comprising means that allow a rotation of the mixer for closing and opening but non-reversibly retain the mixer in the open position.

19. The dispensing device according to claim 18, wherein the locking flange of the at least one of the multicomponent cartridge and syringe comprises recesses in the form of snap tongues and the adjacent bayonet locking members comprise tightening surfaces that are directed toward the at least one of the multicomponent cartridge and syringe.

20. The dispensing device according to claim 7, wherein the valve comprises an opening element which releases the connection between the first outlet and the second outlet of the at least one of the multicomponent cartridge and syringe and a mixing helix after their axial displacement toward the mixer outlet.

21. The dispensing device according to claim 20, wherein the opening element is a U-shaped closure loop each shank of which, as seen from its end, has a conical closure plug in order to limit the opening movement, a constriction, and a collar in order to limit the closing movement.

22. The dispensing device according to claim 21, wherein each shank end of the U-shaped closure loop is pushed through a conical bore in a guiding sleeve in a mixer inlet housing and in an outlet of the at least one of the multicomponent cartridge and syringe.

* * * * *